US005724014A

United States Patent [19]

Leikus et al.

[11] Patent Number: 5,724,014

[45] Date of Patent: Mar. 3, 1998

[54] LATCHING RF SWITCH DEVICE

[75] Inventors: Vincent Leikus, Fairfield, Conn.; Yuly Bauer, Brooklyn, N.Y.

[73] Assignee: The Narda Microwave Corporation, Hauppauge, N.Y.

[21] Appl. No.: 627,287

[22] Filed: Apr. 4, 1996

[51] Int. Cl.[6] ..... H01H 53/00

[52] U.S. Cl. ..... 335/4; 333/103

[58] Field of Search ..... 335/4, 5, 103–109

[56] References Cited

U.S. PATENT DOCUMENTS 4,998,082 3/1991 Duimstra ..... 335/151

*Primary Examiner*—Lincoln Donovan

*Attorney, Agent, or Firm*—Brumbaugh, Graves, Donohue & Raymond

[57] ABSTRACT

A latching electromagnetic RF switch is provided with an armature having a permanent magnet mounted thereon. An electromagnetic coil surrounding the armature has a ferromagnetic member mounted opposite the armature. A spring holds the permanent magnet away from the ferromagnetic member, latching the switch in a first position. In a second position, the permanent magnet attracts the ferromagnetic member and holds the armature against the force of the spring latching the switch.

5 Claims, 1 Drawing Sheet

LATCHING RF SWITCH DEVICE

BACKGROUND OF THE INVENTION

This invention relates to a latching electromagnetic RF switch device which has the capability of switching between RF switch states by the application of a current pulse. The device remains in the state to which it is switched until a reverse current pulse is applied.

It is an object of the invention to provide a simple, reliable and inexpensive latching RF switch.

SUMMARY OF THE INVENTION

In accordance with the invention there is provided a latching electromechanical RF switch which includes an RF switch cavity having at least two RF ports, each having a coaxial inner conductor extending into the cavity and having a switch contact thereon. A contact leaf member is provided in the RF cavity and is moveable between a first contact position connecting the switch contacts and a second position spaced from the switch contacts. An electromagnetic coil is mounted to a wall of the RF cavity and is provided with a ferromagnetic member. An armature having a permanent magnet and a connecting member extending into the RF cavity and connected to the contact leaf member is arranged for movement by the coil to move the contact leaf member between the first and second positions. A spring is provided urging the armature away from the ferromagnetic member. The spring, the ferromagnetic member and the permanent magnet are arranged to cause the permanent magnet to attract the ferromagnetic member in one position, holding the armature thereat, and to cause the spring to hold the armature and the permanent magnet away from the ferromagnetic member in the other position. The armature is moveable between the positions by supplying a current pulse to the coil.

In the preferred arrangement the coil is a linear coil with a central passage closed by the ferromagnetic member at one end and mounted to the RF cavity wall and receiving the armature at the other end. The ferromagnetic member can include an adjustment component which is moveable into and out of the central passage of the coil.

For a better understanding of the present invention, together with other and further objects thereof, reference is made to the following description, taken in conjunction with the accompanying drawings, and its scope will be pointed out in the appended claims.

DESCRIPTION OF THE PREFERRED EMBODIMENT

Figure 1:
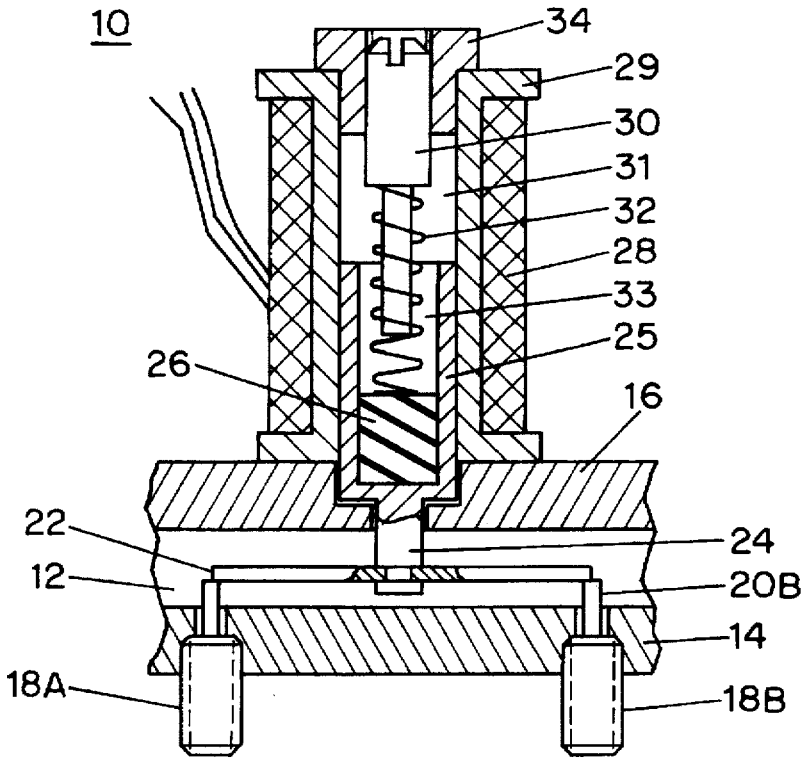
FIG. 1 is a cross-sectional view of an latching electromechanical RF switch according to the present invention.
Figure 2:
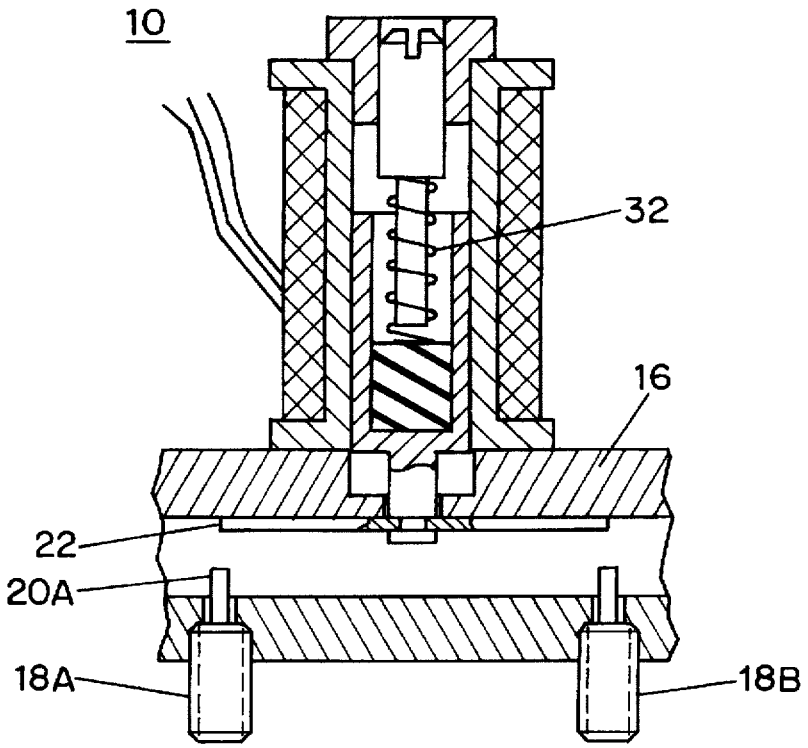
FIG. 2 is a cross-sectional view of the FIG. 1 switch in the open position.

With reference to FIGS. 1 and 2 there is shown a latching electromagnetic RF switch 10 according to the present invention. The switch includes an RF switch cavity 12 having lower and upper conducting walls 14 and 16 and RF ports 18*a* and 18*b*, which may, for example, be coaxial connectors of the SMA type. The RF ports include inner conductors 20*a* and 20*b* which extend into RF cavity 12 and include end surfaces forming contact member for electrical connection to contact leaf member 22. Contact leaf member 22 is carried by a connecting member comprising push rod 24 which extends from an armature assembly 25. The electromagnetic coil 28 is carried on a spool 29 having a hollow central passage 31 into which armature assembly 25 is received. Spool 29 is preferably fabricated of non-ferrous material, such as aluminum, which is coated with teflon to provide lubrication for movement of armature assembly 25 in central passage 31 and additional high voltage insulation for coil 28.

Armature assembly 25 is made of insulating material and is preferably integral with push rod 24. Within a hollow center 33 of armature 25 there is fixedly mounted permanent magnet 26. A magnet pole piece 34 of ferromagnetic material is affixed to the upper end of spool 29 and includes adjustment component 30 comprising a screw also of ferromagnetic material, received in a threaded central bore. Adjustment component 30 has an end extending into central passage 31 toward permanent magnet 26. Compression spring 32 urges armature 25 away from pole piece 34.

In a first position shown in FIG. 1, spring 32 holds permanent magnet 26 away from pole piece 34 and its adjustment component 30, and contact leaf member 22 connects inner conductors 20A and 20B so that the RF switch is ON. When the coil 28 is energized with a pulse of current which cause the lower end of pole piece 34 to have a magnetic polarity attracting the upper end of permanent magnet 26, armature assembly 25 is magnetically pulled up to a second position, shown in FIG. 2, wherein contact leaf member 22 engages the upper wall 16 of RF cavity 12 providing an open circuit and high isolation between RF ports 18*a* and 18*b*. After the current pulse is discontinued, the magnetic attraction between the upper end of permanent magnet 26 and pole piece 34 is greater than in the first position, because of the closer proximity between the two pieces. Accordingly, the magnetic attraction of permanent magnet 26 to adjustment member 30 of pole piece 34 is sufficient to overcome the force of spring 32 and armature assembly 25 is held in the second position. The switch remains in the second, OFF position until a reverse current pulse is applied to coil 28 causing the lower end of adjustment member 30 to have a polarity which repels permanent magnet 26, pushing the armature 25 and the contact leaf member 22 into the first, ON position of FIG. 1.

While a single pole, single throw switch has been used to illustrate the preferred embodiment of the invention, those skilled in the art will recognize that the switching mechanism of the present invention can be easily applied to other switch configurations. A plurality of contact leaf members and coil devices, as shown, can be arranged around a central RF input port for connection to a plurality of surrounding output ports to provide a latching RF single pole, multi-throw switch, having a number of switchable output ports.

Those skilled in the art will also recognize that there can be variations in the RF ports provided and the RF switching cavity. For example, by providing RF ports 18 on cavity wall 16, the contact leaf member 22 will connect the RF ports in an upper position and disconnecting the RF ports in a lower position. In another variation, the RF ports might be other than coaxial, such as strip line, microstrip line or other transmission line well known to those in the art. Accordingly, the term "coaxial inner conductor" as used herein is intended to apply to the corresponding conductor of such other transmission lines.

While there has been described what is believed to be the preferred embodiment of the present invention, those skilled in the art will recognize that other and further changes and modifications may be made thereto without departing from the spirit of the present invention, and it is intended to claim all such changes and modifications as fall within the true scope of the invention.

We claim:

1. A latching electromechanical RF switch comprising:

an RF switch cavity having at least two RF ports, each having a coaxial inner conductor extending into said cavity and having a switch contact thereon;

a contact leaf member in said RF cavity and moveable between a first contact position connecting said switch contacts and a second position spaced from said switch contacts;

an electromagnet coil mounted to a wall of said RF cavity and having a ferromagnetic member;

an armature having a permanent magnet and having a connecting member extending into said RF cavity and connected to said contact leaf member, said armature assembly being moveable by said coil to move said contact leaf member between said first and second positions, and a spring urging said armature away from said ferromagnetic member;

said spring, said ferromagnetic member and said permanent magnet being arranged to cause said permanent magnet to attract said ferromagnetic member in one of said positions holding said armature thereat, and to cause said spring to hold said armature and said permanent magnet away from said ferromagnetic member in the other of said positions, said armature being moveable between said positions by supplying a current pulse to said coil.

2. An RF switch as specified in claim 1 wherein said electromagnetic coil is a linear coil and wherein said coil has a central passage closed by said ferromagnetic member at one end and receiving said armature at the opposite end.

3. An RF switch as specified in claim 2 wherein said armature is arranged to move into and out of said passage at said opposite end and said ferromagnetic member has an adjustment component moveable into and out of said passage.

4. An RF switch as specified in claim 2 wherein said coil is mounted perpendicular to a wall of said RF cavity, wherein said armature is arranged to move into and out of said passage at said opposite end and wherein said connecting member extends from said armature in a direction opposite to said ferromagnetic member, into said RF cavity.

5. A latching electromechanical RF switch comprising:

an RF switch cavity having at least two RF ports, each having a coaxial inner conductor extending into said cavity and having a switch contact thereon;

a contact leaf member in said RF cavity and moveable between a first contact position connecting said switch contacts and a second position spaced from said switch contacts;

a linear electromagnetic coil mounted to a wall of said RF cavity, said coil having a central passage mounted above an opening in said wall and extending perpendicular to said wall, said coil having a ferromagnetic member mounted at an end of said passage remote from said wall;

an armature in said passage having a permanent magnet mounted thereon and having a connecting member extending through said opening and supporting said contact leaf member, said armature being moveable in said passage toward and away from said ferromagnetic member to move said contact leaf member between said first and second positions; and a spring urging said armature away from said ferromagnetic member;

said spring, said ferromagnetic member and said permanent magnet being arranged to cause said permanent magnet to attract said ferromagnetic member in one of said positions holding said armature and said contact leaf member thereat, and to cause said spring to hold said armature and said permanent magnet away from said ferromagnetic member in the other of said positions, said armature being moveable between said positions by supplying current pulses of opposite polarity to said coil.

* * * * *